US006939258B2

(12) United States Patent
Muller

(10) Patent No.: US 6,939,258 B2
(45) Date of Patent: Sep. 6, 2005

(54) UNITARY BROADHEAD BLADE UNIT

(76) Inventor: Philip Muller, 6 Terrapin La., Mercerville, NJ (US) 08619

( * ) Notice: Subject to any disclaimer, the term of this patent is extended or adjusted under 35 U.S.C. 154(b) by 39 days.

(21) Appl. No.: 10/185,089

(22) Filed: Jun. 28, 2002

(65) Prior Publication Data

US 2003/0022741 A1 Jan. 30, 2003

Related U.S. Application Data

(63) Continuation-in-part of application No. 10/094,125, filed on Mar. 8, 2002, and a continuation-in-part of application No. 09/922,550, filed on Aug. 4, 2001.

(60) Provisional application No. 60/365,249, filed on Mar. 18, 2002, provisional application No. 60/354,214, filed on Feb. 4, 2002, provisional application No. 60/293,307, filed on May 24, 2001, provisional application No. 60/286,030, filed on Apr. 24, 2001, provisional application No. 60/273,819, filed on Mar. 8, 2001, and provisional application No. 60/265,114, filed on Jan. 31, 2001.

(51) Int. Cl.[7] ..... F42B 6/08

(52) U.S. Cl. ..... 473/583

(58) Field of Search ..... 473/583, 584

(56) References Cited

U.S. PATENT DOCUMENTS

| | | | | |
|---|---|---|---|---|
| 2,930,620 | A | * | 3/1960 | Brooks |
| 2,940,758 | A | | 6/1960 | Richter |
| 4,036,499 | A | | 7/1977 | Sherwin |
| 4,175,749 | A | | 11/1979 | Simo |
| 4,210,330 | A | | 7/1980 | Kosbab |
| 4,505,482 | A | * | 3/1985 | Martin |
| 4,570,941 | A | | 2/1986 | Saunders |
| 4,643,435 | A | | 2/1987 | Musaccina |
| 4,928,969 | A | | 5/1990 | Nagatori |
| 4,944,520 | A | | 7/1990 | Fingerson et al. |
| 5,018,747 | A | * | 5/1991 | Brown |
| 5,137,282 | A | * | 8/1992 | Segar et al. |
| 5,165,697 | A | * | 11/1992 | Lauriski et al. ..... 473/584 |
| 5,192,081 | A | * | 3/1993 | Cooper |
| D338,942 | S | | 8/1993 | Giannetti |
| RE34,397 | E | * | 10/1993 | DelMonte et al. |
| 5,288,344 | A | | 2/1994 | Peker |
| 5,368,659 | A | | 11/1994 | Peker |
| 5,482,580 | A | | 1/1996 | Scruggs |
| 5,494,297 | A | | 2/1996 | MacNeil |
| 5,494,298 | A | * | 2/1996 | Maleski |
| 5,496,043 | A | | 3/1996 | Ester |
| 5,567,251 | A | | 10/1996 | Peker |
| 5,567,532 | A | | 10/1996 | Peker |
| 5,618,359 | A | | 4/1997 | Lin |
| 5,636,846 | A | * | 6/1997 | Tinsley |
| 5,711,363 | A | | 1/1998 | Scruggs |
| 5,772,803 | A | | 6/1998 | Peker |
| 5,797,443 | A | | 8/1998 | Lin |
| 5,866,254 | A | | 2/1999 | Peker |
| 5,896,642 | A | | 4/1999 | Peker |
| 5,931,751 | A | | 8/1999 | Cooper |
| 5,950,704 | A | | 9/1999 | Johnson |
| 6,045,468 | A | | 4/2000 | Tinsley et al. |
| 6,290,902 | B1 | | 9/2001 | Zwinkels et al. |
| 6,290,903 | B1 | | 9/2001 | Grace, Jr. |

OTHER PUBLICATIONS

Print out of www.magnusbroadheads.com/glue–on–broadheads.html from Feb. 20, 2003.

Print out of www.magnusbroadheads.com/screw–on–broadheads.html from Feb. 20, 2003.

Print out of www.wenselwoodsman.com/index.html from Feb. 20, 2003.

* cited by examiner

*Primary Examiner*—John A. Ricci
(74) *Attorney, Agent, or Firm*—Pepper Hamilton LLP

(57) ABSTRACT

A unitary blade unit for an archery broadhead includes a tip structure and at least three blades inseparably connected into a single blade unit. The blade unit requires a separate ferrule in order for the blade unit to be secured to an arrow. Thus, the blade unit can be replaced while retaining a previously used ferrule, or vice versa. In a preferred embodiment, the blade unit is formed by metal injection molding.

13 Claims, 9 Drawing Sheets

PRIOR ART

UNITARY BROADHEAD BLADE UNIT

RELATED APPLICATIONS AND CLAIMS OF PRIORITY

This application claims priority to, and incorporates by reference, the U.S. Provisional Patent Application No. 60/354,214, filed Feb. 4, 2002, and the U.S. Provisional Patent Application No. 60/365,249, filed Mar. 18, 2002. This application also claims priority to, is a continuation-in-part of, and incorporates by reference the U.S. Utility patent application Ser. No. 09/922,550, filed Aug. 4, 2001, which in turn claims priority to the now-expired U.S. Provisional Patent Application No. 60/265,114, filed Jan. 31, 2001, and the now-expired U.S. Provisional Patent Application No. 60/293,307, filed May 24, 2001. This application also claims priority to, is a continuation-in-part of, and incorporates by reference the U.S. Utility patent application Ser. No. 10/094,125, filed Mar. 8, 2002, which in turn claims priority to the now-expired U.S. Provisional Patent Application No. 60/273,819, filed Mar. 8, 2001, and the now-expired U.S. Provisional Patent Application No. 60/286,030, filed Apr. 24, 2001.

FIELD OF THE INVENTION

The present invention generally relates to archery equipment. More particularly, the present invention relates to a unitary broadhead blade unit for hunting arrows, along with a method for manufacturing a unitary blade unit for a modular broadhead.

BACKGROUND OF THE INVENTION

Traditionally, archery broadheads are made from multiple pieces that are fitted together. The pieces may include individual blades, a tip, and/or other connecting parts. Traditional broadheads also include a means for connecting the broadhead to an arrow, such as a receptacle designed to fit over the shaft of an arrow, with threads or glue to secure the broadhead to an arrow. However, such broadheads can be expensive to manufacture, and they can become loose, and may even separate, through use or transport.

One attempt to overcome this problem is described in U.S. Pat. No. 6,290,903, to Grace, Jr. As described in FIG. 1 hereto, Grace, Jr. discloses a monolilthic broadhead, including a ferrule 8 and a plurality of blades 5. FIGS. 8A, 8B, and 9 of Grace, Jr., which along with the accompanying text at col. 2, line 49 through col. 4, line 29 are incorporated herein by reference, discloses a method of manufacturing the broadhead using a process known as metal injection molding. However, the broadhead produced by the method described in Grace, Jr. provides several disadvantages. For example, by combining both the ferrule and blade in a single unit, the entire unit must be replaced in order to replace the blades, even if the remainder of the unit (i.e., the ferrule) is suitable for re-use. Alternatively, if the threads or other parts of the ferrule become damaged, the entire unit must be replaced.

Accordingly, it is desirable to provide an improved unitary blade unit for a modular broadhead.

SUMMARY OF THE INVENTION

In accordance with a preferred embodiment of the invention, a unitary blade unit for a modular broadhead includes a tip structure and three or more blades inseparably connected into a single blade-unit. Each blade contains a portion that extends toward the tip structure. Further, the blade unit requires a separate ferrule in order for the blade unit to be secured to an arrow.

Optionally, the blade unit also includes a first adapter to separably connect the blade unit to the ferrule. The adapter may include a cap that is sized and positioned to receive a first portion of the ferrule, and/or a collar that is sized and positioned to receive a second portion of the ferrule. Either or both portions of such an adapter may be integral with or separate from the blade unit. Optionally, the blade unit may also include a second separate adapter for further securing the blade unit to the ferrule.

As further options, the blade unit is preferably formed as a single unit by metal injection molding. In this embodiment, each of the blades preferably has a thickness near a base area that is greater than a thickness at an outer edge. Alternatively, the blade unit may be formed by welding the three or more blades into a single, inseparable unit. In either case, the blade unit is preferably made of metal. Preferably, the tip structure of the blade unit is integrally comprised of front points of the three or more blades. However, in an alternate embodiment the tip structure may extend from front areas of the three or more blades.

A preferred method of manufacturing a blade unit for a modular broadhead may include the steps of providing a mold having one or more cavities that define a multiple-bladed blade unit having two or more blades, inserting a mixture of metal and binder into the mold, compacting the mixture in the mold to form an intermediate blade unit, processing the intermediate blade unit to remove at least a portion of the binder, sintering the intermediate blade unit to form a sintered blade unit, and sharpening the blades to form a cutting edge on each blade to yield a final blade unit. The final blade unit requires a separate ferrule in order to attach to an arrow. Preferably, in this method the mixture is in powdered form, and the sintering step comprises sintering at an elevated temperature and pressure.

Alternately and optionally, the method of manufacturing a blade unit for a modular broadhead may include using metal injection molding to form a blade unit from a mixture that includes metal and a binder, wherein the blade unit has at least two blades and requires a separate ferrule in order to attach to an arrow. In this embodiment, the method may also include the step of manufacturing a separate adapter for securing the blade unit to the ferrule. It may also include forming the blade unit to include a first integral adapter for securing the blade unit to the ferrule, and optionally manufacturing a second separate adapter for further securing the blade unit to the ferrule.

DETAILED DESCRIPTION OF PREFERRED EMBODIMENTS OF THE INVENTION

Figure 2:
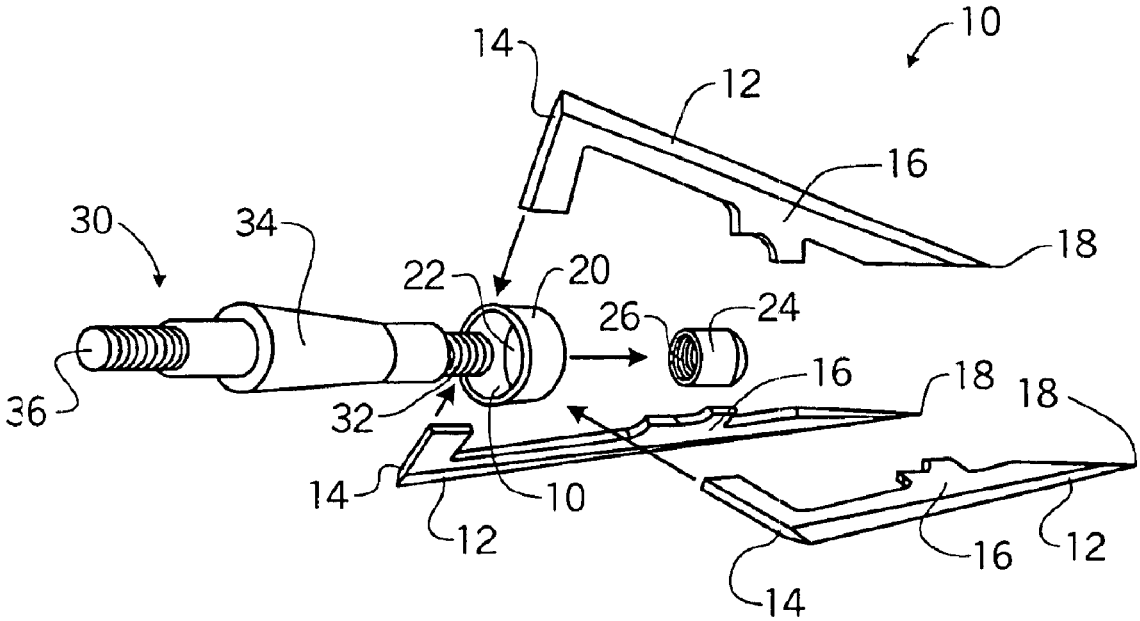
FIG. 2 illustrates an exploded view of a preferred embodiment of the present inventive unitary blade unit, with a separate ferrule.
Figure 3:
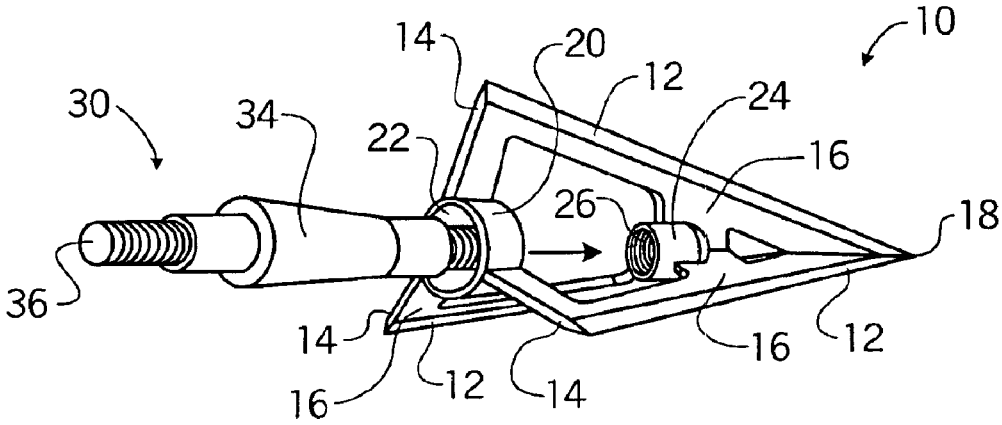
FIG. 3 is a non-exploded view of the blade unit of FIG. 2, also illustrating a separate ferrule before the ferrule engages with the blade unit.

FIGS. 2 and 3 illustrate a first preferred embodiment of the invention. FIG. 2 defines the preferred elements of an embodiment in an expanded view of a blade unit as it receives a ferrule, while FIG. 3 illustrates an as-built view of the embodiment while receiving a ferrule. Referring to FIGS. 2 and 3, blade unit 10 includes three blades 16. More than three blades may be used, although three is the preferred number of blades. Each blade 16 has a razor edge 12 and a base 14.

Figure 1:
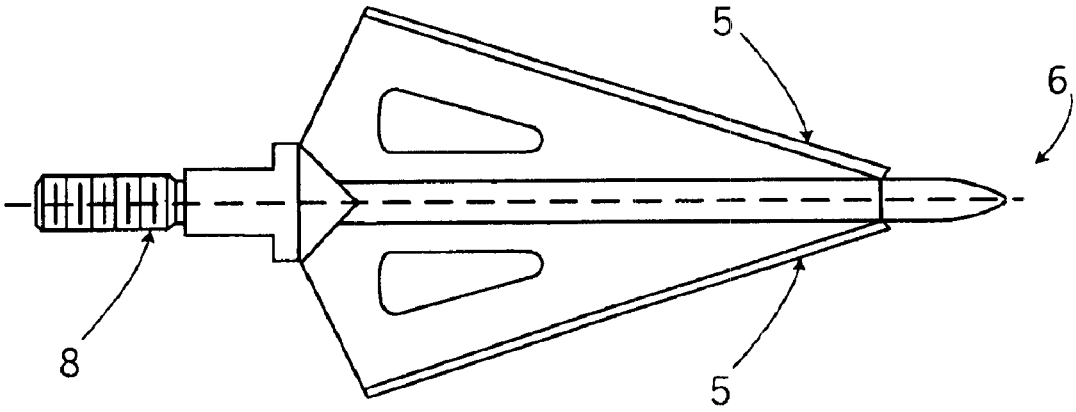
FIG. 1 illlustrates a prior art monolithic broadhead.

In the embodiment illustrated in FIGS. 2 and 3, each blade extends radially from a common frontal point 18 to its base 14. Preferably, and as illustrated, frontal point 18 is formed by the intersection of the at least two of the razor edges 12 to provide the ability to cut a target with the razor edges 12 on contact. Such a tip is sometimes referred to as a "chisel-type" or "cut on contact" tip. However, optionally and alternatively the frontal point 18 may comprise another tip, such as a conical, cylindrical, pyramid-shaped, screwdriver-tip-shaped, or any other type of point that provides a shield or initial contact point over or adjacent to a frontal area of the blades for a "punch cut" before the razor edges meet the target. An example of a conical tip 6 for a punch cut is shown in FIG. 1.

Returning to FIGS. 2 and 3, the blades 16 are interconnected to provide a single, solid blade unit 10. This may be done by welding or brazing the three blades 16 together. Alternately, the blade unit 10 may be singly formed with casting or metal injection molding. The blade unit may also be made by any other means now known or later developed so long as the process produces a unitary blade unit with a tip of some type that is integral with the blade unit.

In the preferred embodiment shown in FIGS. 2 and 3, the base 14 of each blade 16 is connected to a base collar 20 that has a central aperture 22 in alignment with a cap 24. The cap 24 is connected to an interior portion of each blade 16 at a location that is between the collar 20 and the frontal point 18. The cap 24 has a first means for receiving a ferrule 30 after a ferrule 30 is passed through the central aperture 22 of the base collar 20. As illustrated in FIGS. 2 and 3, the means for receiving the ferrule is preferably a series of threads 26, which optionally may be tapered to mate with a tapered series of threads 32 on the ferrule 30. However, other means, such as tabs, holes and pins, or other mechanisms are possible. As used herein, the term "ferrule" means a central shaft or any other separable device that connects the blade unit to the shaft of an arrow. FIGS. 2 and 3 illustrate an exemplary ferrule 30 having a body 34, threads 32 for connecting the ferrule to the blade unit, and threads 36 for connecting the ferrule to an arrow shaft. Again, other means, such as tabs, holes and pins, or other mechanisms are possible.

Figure 4:
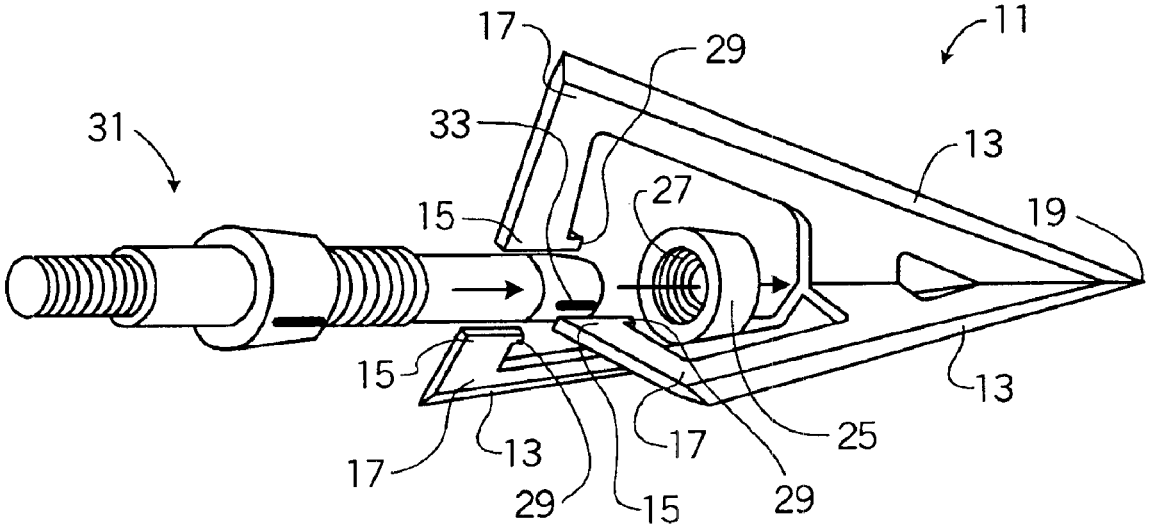
FIG. 4 illustrates an alternate embodiment of a unitary blade unit before a ferrule engages with the blade unit.

The base collar 20 such as that illustrated in FIGS. 2 and 3 is preferably integral with the blade unit. However, in an alternate embodiment, as illustrated in FIG. 4, if a ferrule 31 is equipped with slots 33 or other means to receive the bases 15 of each blade 17, the integral base collar may be omitted. In such an embodiment, a locking collar 25 may be provided, with a means of mating with the ferrule 31, such as threads 27 as illustrated in FIG. 3, although other mating means may be used. Returning to FIG. 4, optionally and preferably, the bases 15 of each blade would include a projection 29 such as a tab to further secure the base 15 to the slot 33. However, whether or not this option is used, the locking collar 25 secures the blade unit 11 to the ferrule 31. In such an embodiment, a cap between the locking collar 25 and the frontal point 19 is not required.

Figure 5:
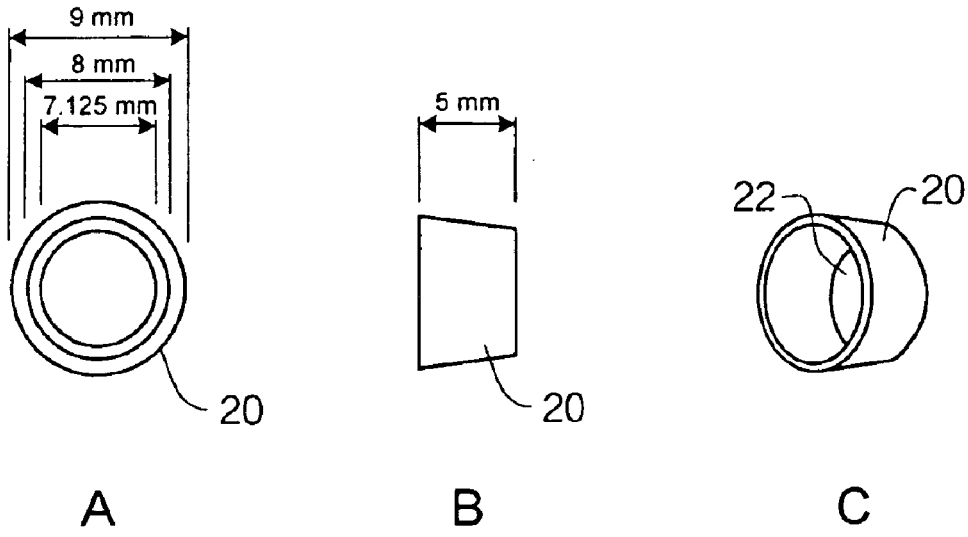
FIGS. 5A, 5B, and 5C show isolated views of the base collar originally shown in FIGS. 2 and 3 with preferred dimensions.
Figure 6:
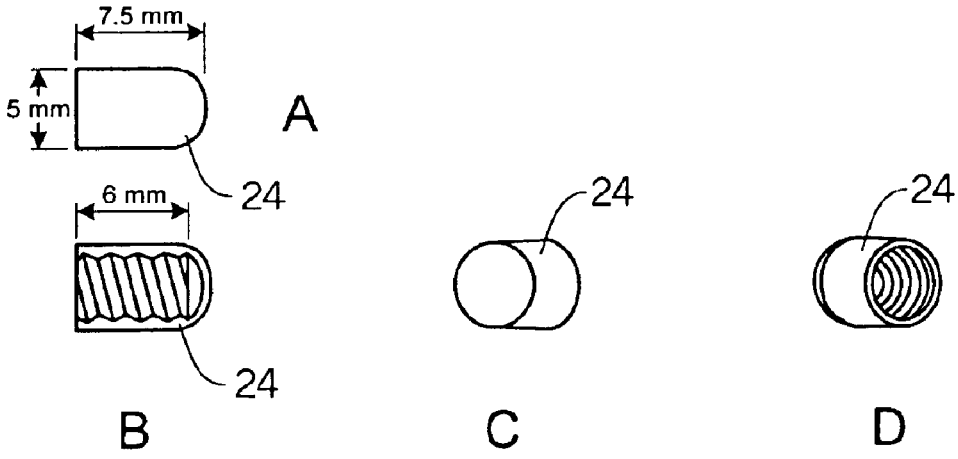
FIGS. 6A, 6B, and 6C show isolated views of the cap originally shown in FIGS. 2 and 3 with preferred dimensions.
Figure 7:
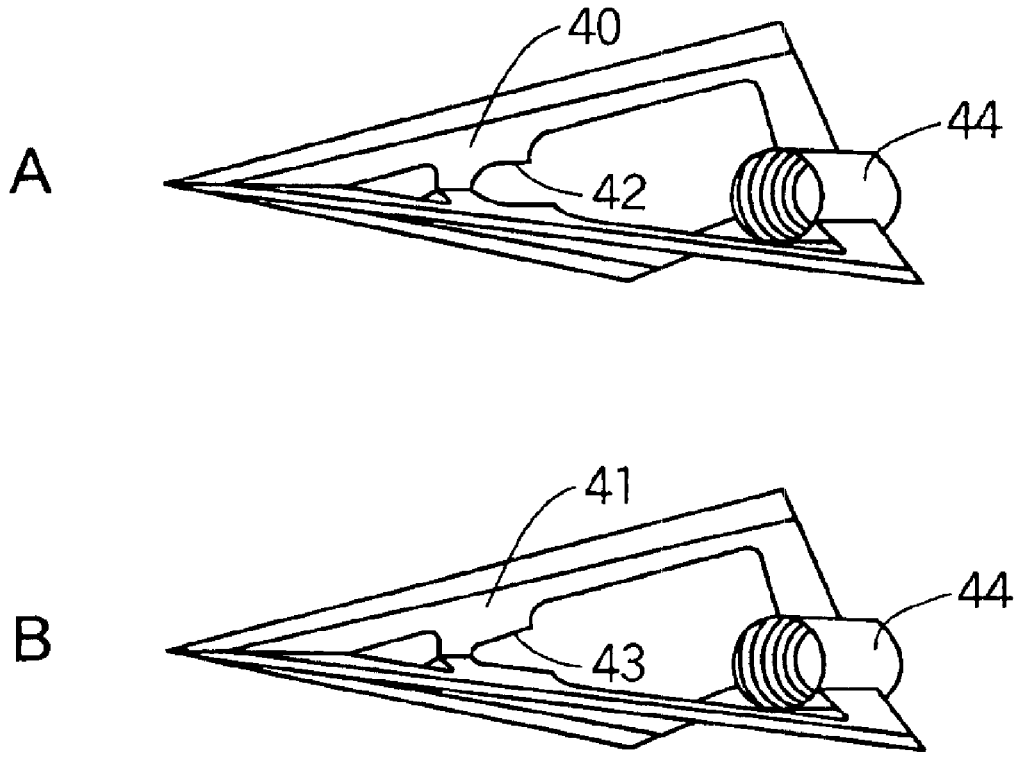
FIGS. 7A and 7B illustrate variations of a unitary blade unit where a separate cap is not required.

FIGS. 5A, 5B, and 5C show isolated views of a preferred embodiment of the base collar 20 with preferred dimensions. However, other dimensions are possible, depending on the size of the ferrule and desired blade unit. Similarly FIGS. 6A, 6B, and 6C show isolated views of a cap 24 with preferred dimensions. Other dimensions are possible, depending on the size of the ferrule and desired blade unit. As a further alternative, FIGS. 7A and 7B illustrate embodiments where a separate cap is not required. Instead, in these embodiments, a means for receiving the edge or tip of a ferrule is formed by the undersides of the blades 40 themselves. Here, the "cap" may comprise the blades themselves, which are preferably formed with grooves 42 to receive threads of a ferrule, tabs 43 to lock with one or more recesses of a ferrule, or holes, pins, raised edges, or other means to secure a ferrule in place, preferably and optionally after a ferrule is placed through an integral collar 44. Optionally, the collar 44 may include threads to further secure the ferrule to the blade unit.

Returning to FIGS. 2 and 3, the embodiment using a base collar 20 may also include an optional means for connection to a ferrule 30. Such a means may include, for example, a taper, preferably about two degrees to about ten degrees, more preferably about five degrees, to mate with the ferrule and prevent it from moving through a force fit. The taper may be on the body 34 of the ferrule, as shown in FIGS. 2 and 3, or it may be elsewhere.

In the preferred embodiment of FIGS. 2 and 3, the blade unit 10 may receive the ferrule 30 when a person or device inserts the front portion of the ferrule 30 through the base collar 20 until the front portion (such as threaded area 32) is received by the cap 24. The ferrule 30 is then rotated such that the threaded area 32 screws into the cap 24. As the front portion 32 is drawn into and connects with the cap 24, the central portion 34 of the ferrule is drawn into, mates inside of, and tightens in the central aperture 22 of the base collar 20. By screwing the ferrule 30 tightly into the blade unit 10, a secure connection is made. Of course, as mentioned above, other means of connection, such as pins or locking tabs, may be used. Examples of blade units that may connect by tabs and/or grooves are shown in FIGS. 4, 7A and 7B.

The frontal point 18 of the blade unit is the first part that will contact a target. Since it is just a point, and since it will receive a tremendous force upon impact, it is preferred that the blade unit be constructed in such a way that it has additional strength. This can be accomplished by tapered grinding, moving over a sharpening stone, or other sharpening of the razor edges 12. With such a procedure, each razor edge 12 may be sharpened at an angle that is greater than the angle that the razor edge 12 is adjacent to the base 14 of the blade 16. Near the frontal point 18, the angle is preferably less sharp, this providing a wider cutting edge near the frontal point 18 than near the base 14.

The unitary blade unit is preferably made of any metal. More preferably, the unitary blade unit is made using carbon steel, stainless steel, spring steel, tool steel, or titanium, or a composition including any of the above.

Figure 8:
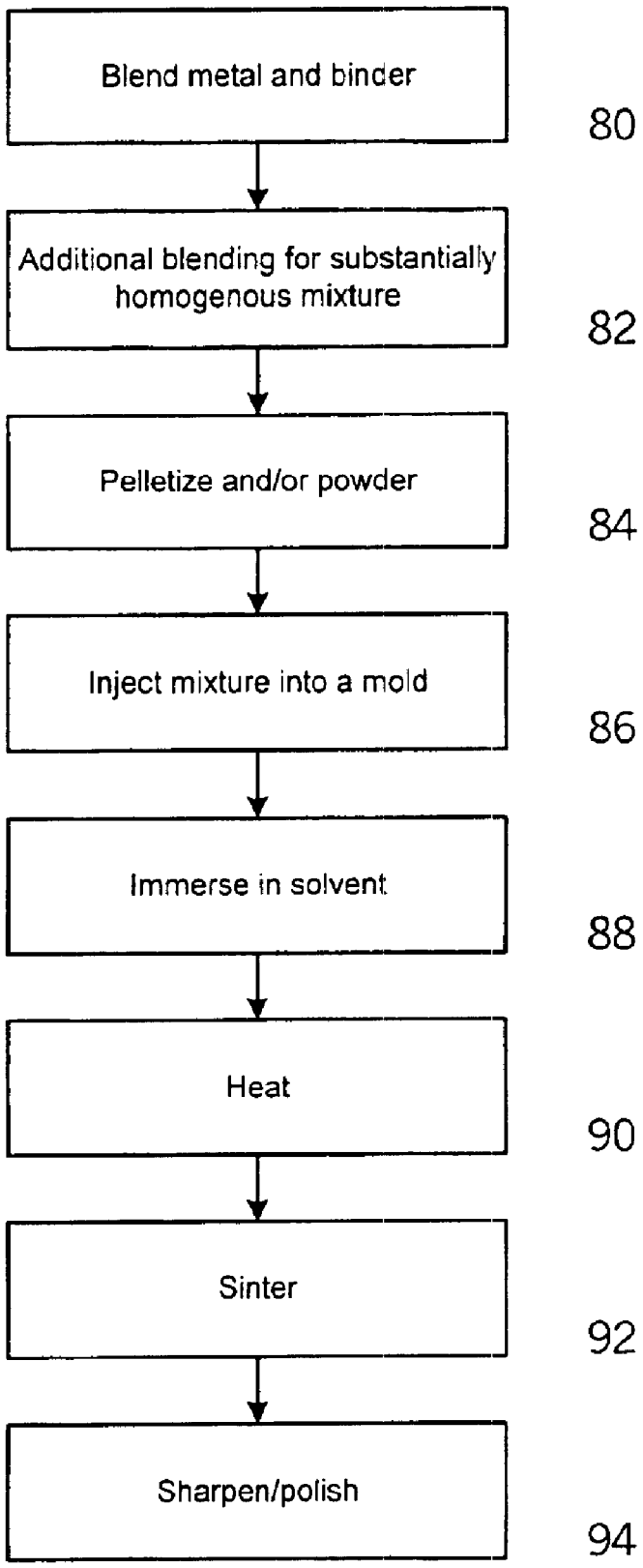
FIG. 8 illustrates preferred steps of manufacturing a unitary blade unit using metal injection molding.
Figure 9:
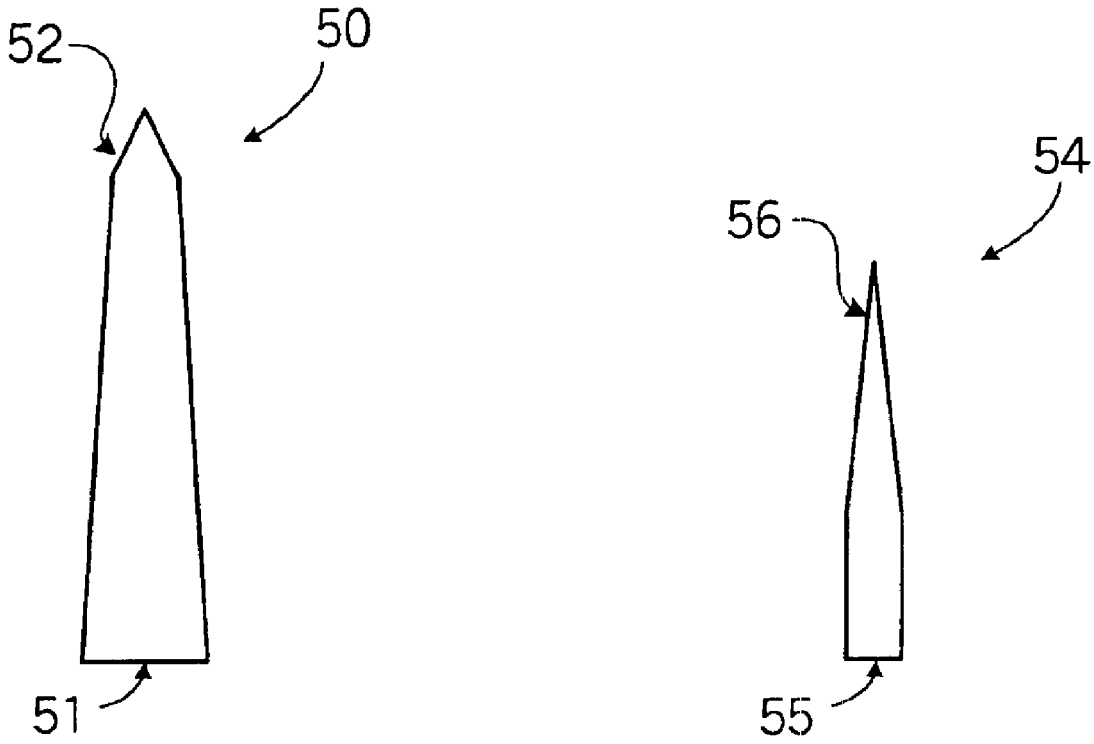
FIG. 9 illustrates exemplary blades that may be produced when manufacturing a blade unit using metal injection molding.

In a preferred method of manufacturing the unit using metal injection molding, the steps shown in FIG. 8 may be followed. Referring to FIG. 8, the unitary blade unit may be formed by blending a metal powder and binder (such as plastic or wax). The blending may be done in a single step 80, or in two or more graduated steps 82. The mixture is pelletized and/or powdered 84 (optionally in combination with the blending step), and it is injected 86 into a blade unit mold having one or more cavities that provide a desired blade unit design. The method may use a mold that provides a blade unit having two, three, four, or more blades, although the preferred number is three blades. Preferably, the mixture is compacted in the mold with pressure to yield an intermediate piece. The piece is processed (such as by immersion in a solvent 88, optionally followed by heating 90) to remove at least a portion of the binder. The piece is then sintered 92 at an elevated temperature and/or pressure to reduce the size and increase the density of the blade unit. After sintering, optionally and preferably the blade unit edges may be sharpened 94 using either a conventional or a specially-designed sharpening tool. Other embodiments of molding may also be used to manufacture the blade unit. This preferred method embodiment of the present invention is intended to include the use of metal injection molding to manufacture any unitary blade-unit that is separate from a ferrule, including but not limited to the blade units illustrated in FIGS. 2, 3, and 4 and variants thereof. Preferably, although not a necessary element, when manufacturing a blade unit using metal injection molding, each blade is tapered so that it is thicker at its base than it is at the frontal tip. Examples of such tapered blades are shown in FIG. 9, which illustrates rear views of exemplary blades 50 and 54, each of which has a base 51 and 55 and having a thickness that begins to taper at some point between the base and the tip or outer edge 52 and 56.

Figure 10:
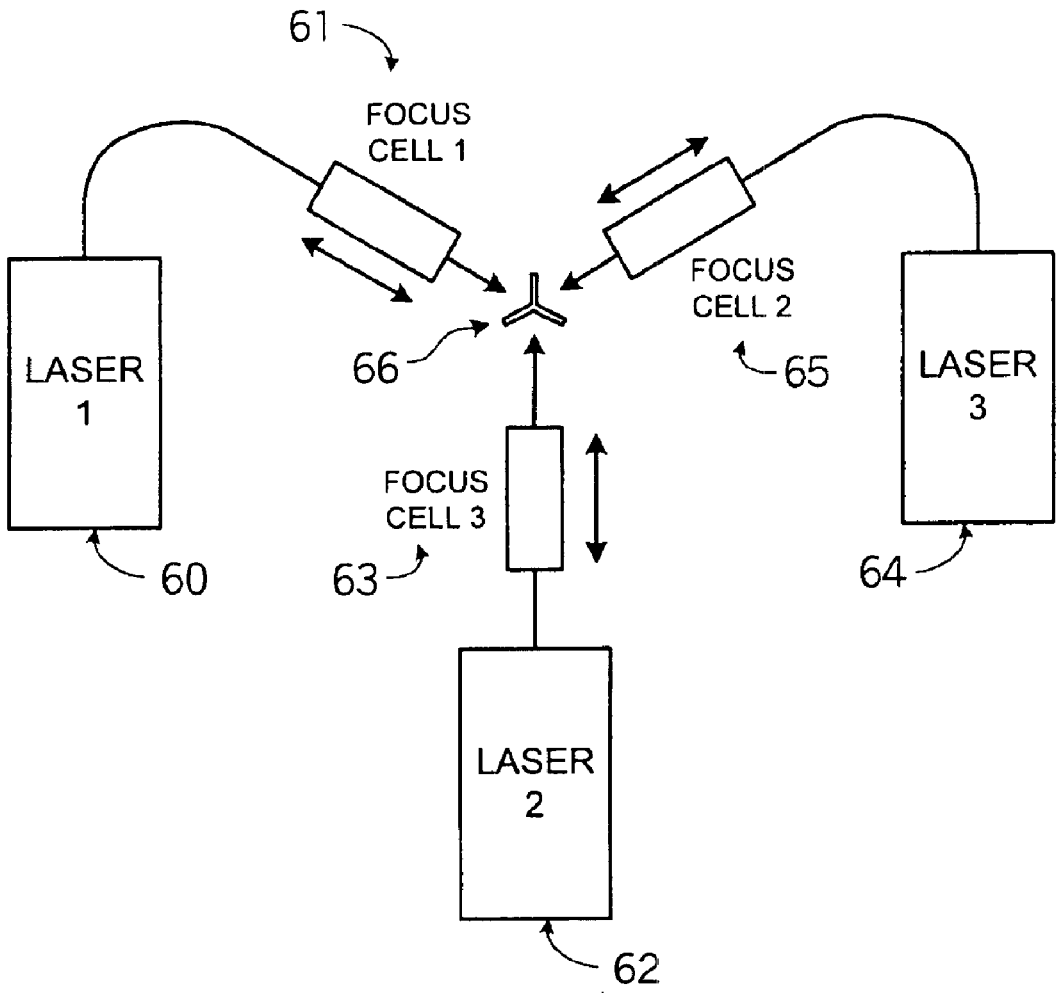
FIG. 10 illustrates a preferred laser welding process.
Figure 11:
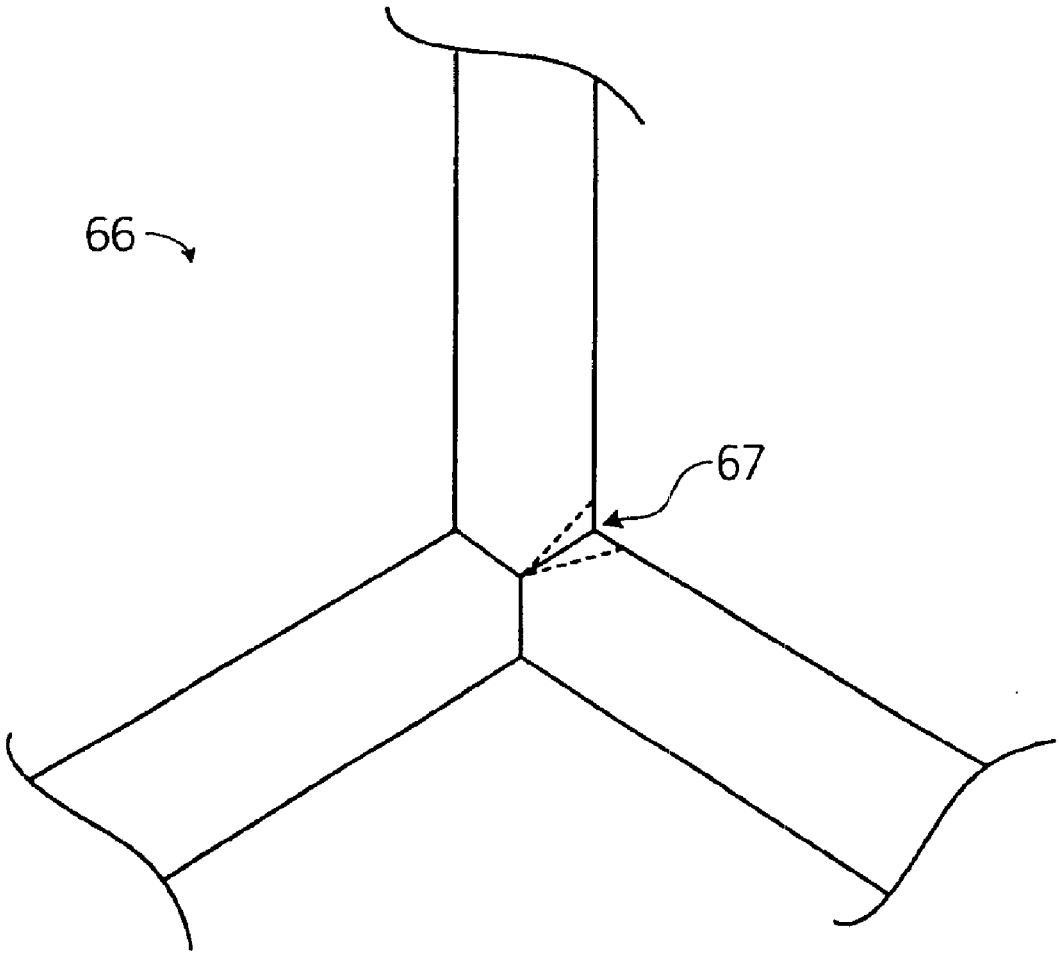
FIG. 11 provides a close-up view of an exemplary tip structure for a blade unit as produced by the laser welding process of FIG. 10.

Alternatively, the blade unit may be made by assembling the blades into a unitary structure. Preferably, with this method the blades will be fastened together using any commonly known welding procedure such as laser welding, electron beam welding, TIG welding, plasma welding, resistance welding, electron beam welding, fusion welding, pressure welding, friction welding, ultrasonic welding, or other welding methods. Preferably, when manufacturing the unit by welding, the weld of each seam is begun at or near the frontal point and proceeds toward the base. Alternatively, fastening methods other than welding may be used. Exemplary laser welding equipment and procedures are illustrated in FIG. 10. Referring to FIG. 10, a laser unit 60 directs a beam of energy toward an intersection of two blades of an exemplary blade unit 66. A closer view of the tip structure of blade unit 66 is provided in FIG. 11, which also shows the points of intersection 67. The beam of energy is preferably directed toward the intersection 67 using a focus cell 61, mirror, or other device that focuses the beam toward the point of intersection. The energy beam fuses the blades at the point of intersection 67. This process is performed for each point of intersection, preferably simultaneously with multiple lasers and focus cells such as is shown in FIG. 10, but optionally with a single laser that welds on a joint-by-joint basis. Preferably, the weld is performed into the tip structure to provide a "cut on contact" blade unit. However, alternate tip structures are possible.

The unitary blade unit provides several advantages over the prior art. For example, by providing a separate blade unit and ferrule, a user can replace only one part (i.e., either the blade or the ferrule) without replacing the other, thus reducing replacement costs. In addition, the separation of blade and ferrule allows the manufacturer to provide a weight-adaptable broadhead by manufacturing a standard blade unit and varying ferrules having different weights. In addition, the blade unit and the ferrule may be made of different materials. Thus, the weight of the overall broadhead (i.e., the combination of the blade and ferrule) optionally may be varied by changing the ferrule without replacing the blades, or vice versa. Further, although the blade-unit can be sharpened by grinding, polishing, sanding, or any standard sharpening method, the user may decide to simply dispose of the unitary blade unit and attach a new blade unit to an existing ferrule, resulting in ease of use for the user and the potential for increased sales for the manufacturer.

When made by metal injection molding, the blade unit designer receives a tremendous amount of freedom in the shaping and designing of the unit. Exact radii, tapering, and other intricacies can be achieved with minimal cost difference. Metal injection molding also allows metal parts to have a complex geometry with great strength.

The many features and advantages of the invention are apparent from the detailed specification. Thus, the invention is intended to include all such features and advantages of the invention which fall within the true spirits and scope of the invention. Further, since numerous modifications and variations will readily occur to those skilled in the art, it is desired to limit the invention to the exact construction and operation illustrated and described in the specification, claims, and drawings herein. Accordingly, all appropriate modifications and equivalents may be included within the scope of the invention.

I claim:

1. A unitary blade unit for a modular broadhead, comprising;

a tip structure; and three or more blades permanently connected into a single blade-unit, wherein at least two of the blades contain a portion that extends toward the tip structure;

wherein the blade unit requires a separate ferrule in order for the blade unit to be secured to an arrow.

2. The blade unit of claim 1, further comprising a first adapter to separably connect the blade unit to the ferrule.

3. The blade unit of claim 2, further comprising a second separate adapter for further securing the blade unit to the ferrule.

4. The blade unit of claim 2, wherein the adapter comprises a cap sized and positioned to receive a first portion of the ferrule.

5. The unitary blade unit of claim 4, wherein a second adapter comprises a collar that is sized and positioned to receive a second portion of the ferrule.

6. The blade unit of claim 2 wherein the adapter is separate from the blade unit.

7. The blade unit of claim 1, wherein the blade unit is formed as a single unit by metal injection molding.

8. The blade unit of claim 7 wherein a separate adapter is separately formed to separably connect the blade unit to the ferrule.

9. The blade unit of claim 7 wherein each of the blades has a thickness near a base area that is greater than a thickness at an outer edge.

10. The blade unit of claim 1, wherein the blade unit is formed by welding the three or more blades into a single, inseparable unit.

11. The unitary blade unit of claim 1 wherein the blade unit is comprised of metal.

12. The unitary blade unit of claim 1 wherein the tip structure is integrally comprised of front points of the three or more blades.

13. The unitary blade unit of claim 1 wherein the tip structure extends from front areas of the three or more blades.

* * * * *